US008814758B1

(12) United States Patent
Mattox

(10) Patent No.: US 8,814,758 B1
(45) Date of Patent: Aug. 26, 2014

(54) HAND PROTECTOR

(76) Inventor: E. Michael Mattox, Blue Springs, MO (US)

( * ) Notice: Subject to any disclaimer, the term of this patent is extended or adjusted under 35 U.S.C. 154(b) by 610 days.

(21) Appl. No.: 13/098,877

(22) Filed: May 2, 2011

Related U.S. Application Data

(60) Provisional application No. 61/331,604, filed on May 5, 2010.

(51) Int. Cl.
*A63B 69/34* (2006.01)
*A63B 71/00* (2006.01)

(52) U.S. Cl.
USPC ..... 482/83; 482/141; 482/139

(58) Field of Classification Search
USPC ..... 482/83–90, 142, 148
See application file for complete search history.

(56) References Cited

U.S. PATENT DOCUMENTS

| | | | | | |
|---|---|---|---|---|---|
| 3,755,820 | A * | 9/1973 | Petrusek | 2/18 |
| 4,632,387 | A * | 12/1986 | Guzman | 482/111 |
| 5,325,997 | A * | 7/1994 | Washington et al. | 222/175 |
| 5,447,308 | A * | 9/1995 | Girard | 463/47.2 |
| 5,685,809 | A * | 11/1997 | Murray | 482/105 |
| 5,846,168 | A * | 12/1998 | Murray | 482/105 |
| 6,672,993 | B2 * | 1/2004 | Stout | 482/55 |
| 7,481,753 | B2 * | 1/2009 | James et al. | 482/140 |
| 7,553,267 | B1 * | 6/2009 | Hauser et al. | 482/141 |
| D597,153 | S * | 7/2009 | Friedman et al. | D21/662 |
| 7,585,262 | B1 * | 9/2009 | Vayntraub | 482/141 |
| 7,935,040 | B2 * | 5/2011 | Moskowich | 482/141 |
| D654,545 | S * | 2/2012 | Richard | D21/662 |
| 8,454,485 | B1 * | 6/2013 | Hodes et al. | 482/108 |
| 2004/0116256 | A1 * | 6/2004 | Stout et al. | 482/55 |
| 2008/0051272 | A1 * | 2/2008 | Lazar | 482/139 |

* cited by examiner

*Primary Examiner* — Stephen Crow
(74) *Attorney, Agent, or Firm* — McGarry Bair PC

(57) ABSTRACT

A hand protector for use in punching bag exercises comprising a concave shield and a grip mounted in the open mouth of the shield. The shield is shaped and sized to receive a human hand when the hand is wrapped around the grip in the manner to form a fist.

19 Claims, 5 Drawing Sheets

HAND PROTECTOR

CROSS-REFERENCE TO RELATED APPLICATION

This application claims the benefit of U.S. Provisional Patent Application No. 61/331,604, filed May 5, 2010, which is incorporated herein by reference in its entirety.

BACKGROUND OF THE INVENTION

1. Field of the Invention

This invention relates to a hand protector. In one of its aspects, the invention relates to a fist or hand protector for use in work outs with punching of heavy bags. In another of it aspects the invention relates to an exercise devise for aiding punching bags or doing push-ups. In another of its aspects, the invention relates to a method for exercising using unique equipment that protects the user's hands and wrists from damage. In still another of its aspects, the invention relates to a method for exercising with equipment that protects the user's hands and wrists from injury.

2. Description of Related Art

In the field of exercise, many people work out by punching a heavy bag. Typically, the work out is with bare hands or with gloves. Sometime, the puncher's hands get injured or broken due to improper form. In addition, wrists can be sprained or broken.

The problem is the fist is made of many bones of the fingers and hand. Forces upon impact to the fist can land in a firm and even way about the fist or be off center and uneven causing overloading to a smaller number of bones. This uneven impact to the fist sends forces to the wrist off center to the bones of the wrist and thereby causes injury. The forces to the fist upon impact travel along the top or outside of the hand through the bones of the hand directly to the top or outside of the bones of the wrist. If the forces upon impact were directed to the center of the fist and from that point directed to the wrist, the problem would be greatly reduced and boxers would condition and improve their punch without the fear of injury.

Vayntraub, U.S. Pat. No. 7,585,262 discloses convex push-up handles which are used for push up exercises. The handles have a semi-circular shell and the handles are removably mounted inside the shell. The shells rest upright on a surface when the user's hands grip the handles to exercise by doing push-ups. When performing exercises of this nature, the hands tend to rotate during the exercise. When performed on a rug or padded surface, friction between the shell and the surface can inhibit or restrict rotational motion of the hands with respect to the surface and may cause injury to the user.

SUMMARY OF THE INVENTION

According to the invention, a hand protector for use in punching bag exercises comprises a shield made of a structural material and having a bight portion with an exterior surface that is adapted to resist deformation when struck against an article such as a punching bag and upright portions extending from the bight portion. The hand protector further comprises a hand grip rigidly mounted at the ends thereof to the shield upright portions. The hand grip is mounted in spaced relationship to the shield so that a user gripping the hand grip with a hand has hand portions spaced from the shield for protection during punching exercises.

In one embodiment, a pad is rotatably mounted to the exterior surface of the bight portion of the shield in alignment with the hand grip.

In one embodiment of the invention, the shield of the hand protector is formed in one of a partial spherical, a U-shaped, and a cup-shaped configuration. In addition, the bight portion can be relatively flat or have a slight curve.

In another embodiment, the shield is U-shaped in configuration and the upright portions comprise legs of the U-shape portions, and the handle is mounted between the legs. Further, one of the legs is longer than the other, and the longer leg has a strap for securing the arm of the user when the user's hand grips the hand grip in order to support the wrist.

In another embodiment of the invention, the pad is removably to the exterior surface of the shield. The pad can be a disc having a pin perpendicular to the disc, wherein the pin is mounted in a hole in the bight portion. In a preferred embodiment, the disc and pin are integrally formed from a moldable resin material. Further, the pad can include a layer of compressible material mounted to an outer surface of the disc.

In another embodiment, the hand protector includes pads mounted to the handle between a central portion thereof and the legs of the shield and configured to protect the user's hand during punching exercises.

In yet another embodiment, the shield is formed in a U-shape and the upright portions comprise side plates positioned between legs of the U-shape, wherein the handle is mounted between the side plates.

In another embodiment, the hand grip comprises a hollow, cylindrically shaped handle, and a bolt extends through the handle and is attached at either end to the shield. Preferably, the handle is padded.

Further according to the invention, a hand protector for use in punching bag exercises comprises a shield made of a structural material and having a bight portion with an exterior surface that is adapted to resist deformation when struck against an article such as a punching bag and legs extending from the bight portion. A hand grip is rigidly mounted at the ends thereof between the shield legs. The hand grip is mounted in spaced relationship to the shield so that a user gripping the hand grip with a hand has hand portions spaced from the shield for protection during a punching exercise. One of the legs is longer than the other, and the longer leg has a strap for securing the arm of the user when the user's hand grips the hand grip.

In one embodiment, the longer of the legs is configured to support the arm and/or wrist of the user when the strap is secured to the user's arm. Preferably, the legs are relatively straight and the longer of the legs can be bent slightly to conform to the arm of a user. In addition, the bight portion can be substantially flat or have a slight curve. In addition a pad can be mounted to the outside surface of the bight portion. Preferably, the pad is rotatably mounted to the bight portion.

In another embodiment, the strap has hook and loop fasteners to removably secure the strap to the arm of a user.

Further according to the invention, a method of exercising comprises punching a bag with one's hands wherein at least one of the hands of the puncher grips the hand grip of hand protector described above. Further, a portion of the user's arm can be bound by the strap.

Another method according to the invention comprises positioning one's body in a push-up position and executing at least one push-up wherein the hands of the body grip the hand protector described above. Further, the straps can bind at least a portion of the arms of the body to brace the wrists with respect to the hands.

In addition to protection to the hand, fist, or wrist, the hand protector according to the invention can benefit anyone wanting higher levels of conditioning. Because of automatic gains of power to the punch and higher level of cardio, better neutral muscular pattern of a perfect punch can be realized. In addition to a boxing trainer and conditioner, the hand protector according to the invention provides a safe and easy way for anyone to punch their stress away. The idea of grasping the safe, hand protector according to the invention and punch, punch, punch without hurting the hands, fist, or wrists, and without putting on wrist wraps and chunky gloves that don't prevent pain and injury is a powerful concept.

DESCRIPTION OF AN EMBODIMENT OF THE INVENTION

Figure 6:
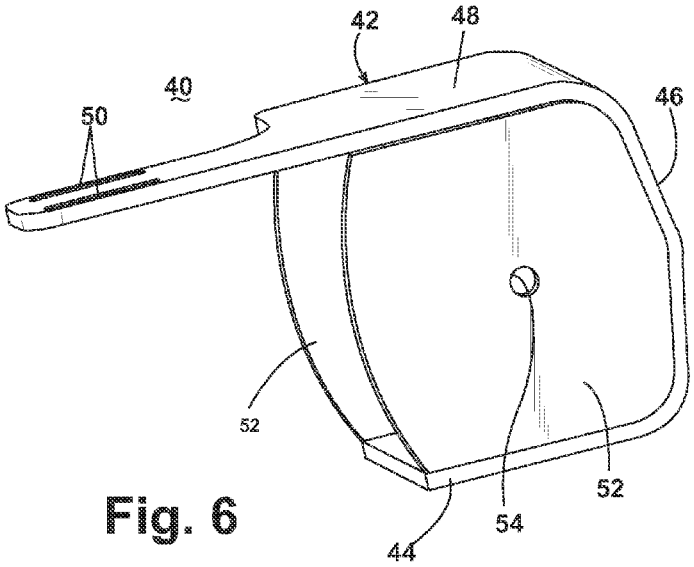
FIG. 6 is a side perspective view of a hand protector further comprising side plates, according to another embodiment of the invention.
Figure 7:
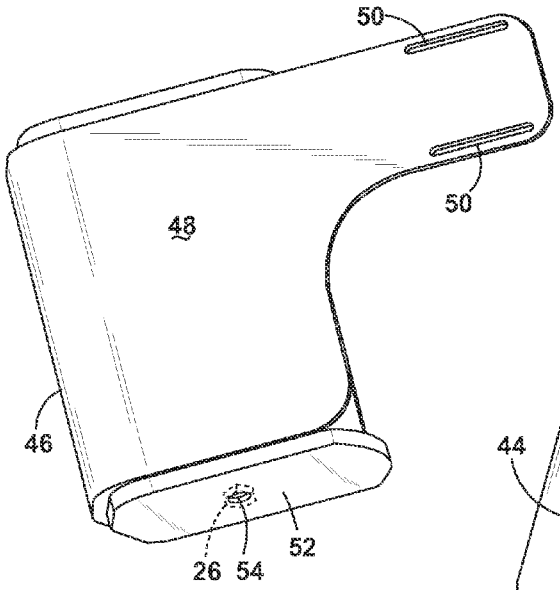
FIG. 7 is a side perspective view of the hand protector of FIG. 6, rotated 90 degrees.

Referring now to the drawings and to FIGS. 1-4, there is shown a hand protector 12 according to the invention. The hand protector 12 comprises a U-shaped shield 14 and a handle or hand grip 24. The U-shaped shield 14 comprises a relatively flat short leg 16, a relatively flat bight portion 18, and a relatively flat long leg 20 having slotted openings 22. A bolt 26 extends through the legs 16 and 20 and mounts the handle 24 between the legs 16 and 20. As shown in FIGS. 6 and 7, a strap 28 is threaded through the slotted openings 22 and is wrapped around the arm of the user to secure the arm which extends along the leg 20 when the user's hand grips the handle 24. The leg 20 is configured to support the wrist of the user when the strap is secured to the user's arm. In FIG. 5, the bight portion 18 is shown as being relatively flat, whereas in FIGS. 6 and 7 the bight portion 18 is shown as being slightly convex. The shield 14 over the handle 24 protects the fist from impact when punching a heavy punch bag (not shown).

The strap 28 can be made from a variety of materials, including stretch fabric that is commonly used in athletic clothing and for binding portable MP-4 audio modules to one's arm. The strap 28 can include a Velcro hook material **29*a* on the end thereof to bind the wrapped strap onto a piece of Velcro hook material 29*b* on a central portion of the strap. In lieu of the slotted openings 22, Velcro fasteners can be used to secure the strap to the 29 to the leg 28**.

The handle 24 is mounted in spaced relationship to the shield 14 such that a user gripping the handle 24 with their hand has hand portions spaced from the shield 14 for protection during a punching exercise. A grip covers the handle 24 and is padded to absorb the force of impact sustained by the user's palm. The handle 24 can be made of a structural material (plastic, steel, or other suitable material) strong enough to take repeated heavy impact.

The shield 14 can be made of high impact material such as steel, plastic, or any other suitable structural material that is adapted to resist deformation when struck against an article, such as a punching bag (not shown). If made from plastic, the handle 24 can be integrally formed with the shield 14.

Figure 4:
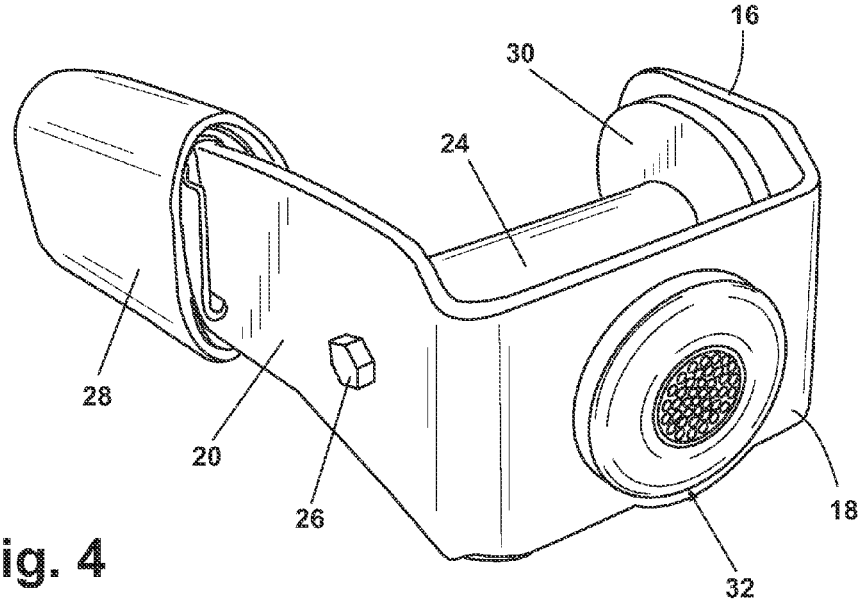
FIG. 4 is a perspective view of the hand protector of FIG. 1, and further comprising a padded disc positioned on an exterior surface of the hand protector.
Figure 5:
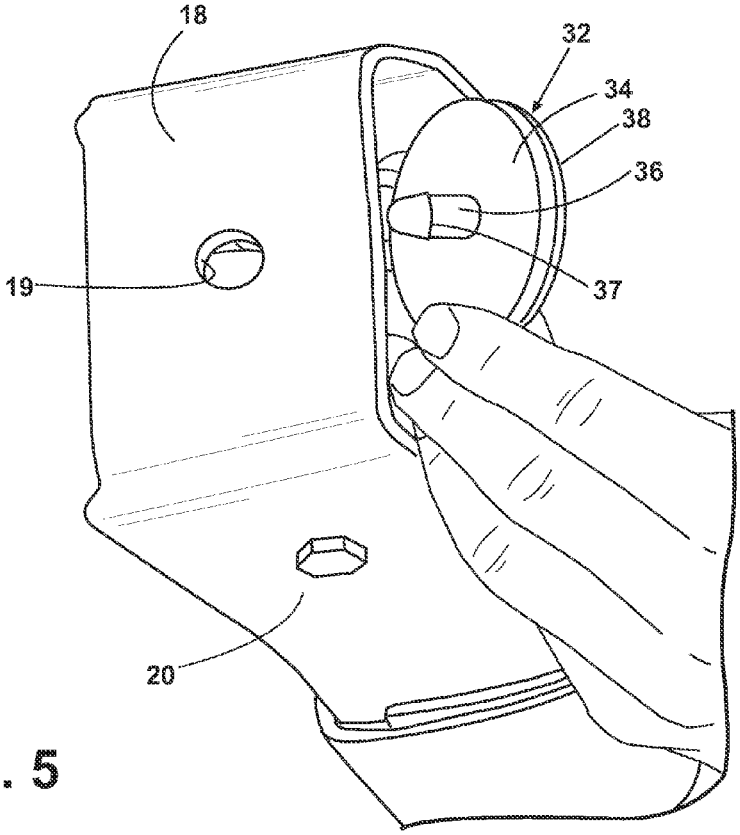
FIG. 5 is a partial exploded view of the hand protector and padded disc shown in FIG. 4.

Referring now to FIGS. 4-5, the hand protector 12 further comprises a rotatable padded disc 32 removably attached to the exterior surface of the bight portion 18 for rotation with respect thereto. The padded disc 32 comprises a plastic disc 34 having a tapered integrally formed pin 36 projecting perpendicular therefrom and which is adapted to mount in a through hole 19 in the bight portion 18. The pin 36 has an undercut 37 that is slightly larger than the diameter of the hole 19 and snaps into place on the inside surface of the bight portion 18 to removably retain the disc 32 in place on the bight portion 18. The pin connection with the bight portion 18 rotatably mounts the disc 32 to the bight portion. In addition, an outer pad 38 of a foam or other soft or compressible material is mounted to the disc 34. The padded disc 32 is mounted to the bight portion 18 for relative rotation to accommodate any rotational movement of the user's hand during punching or push up exercises.

Figure 1:
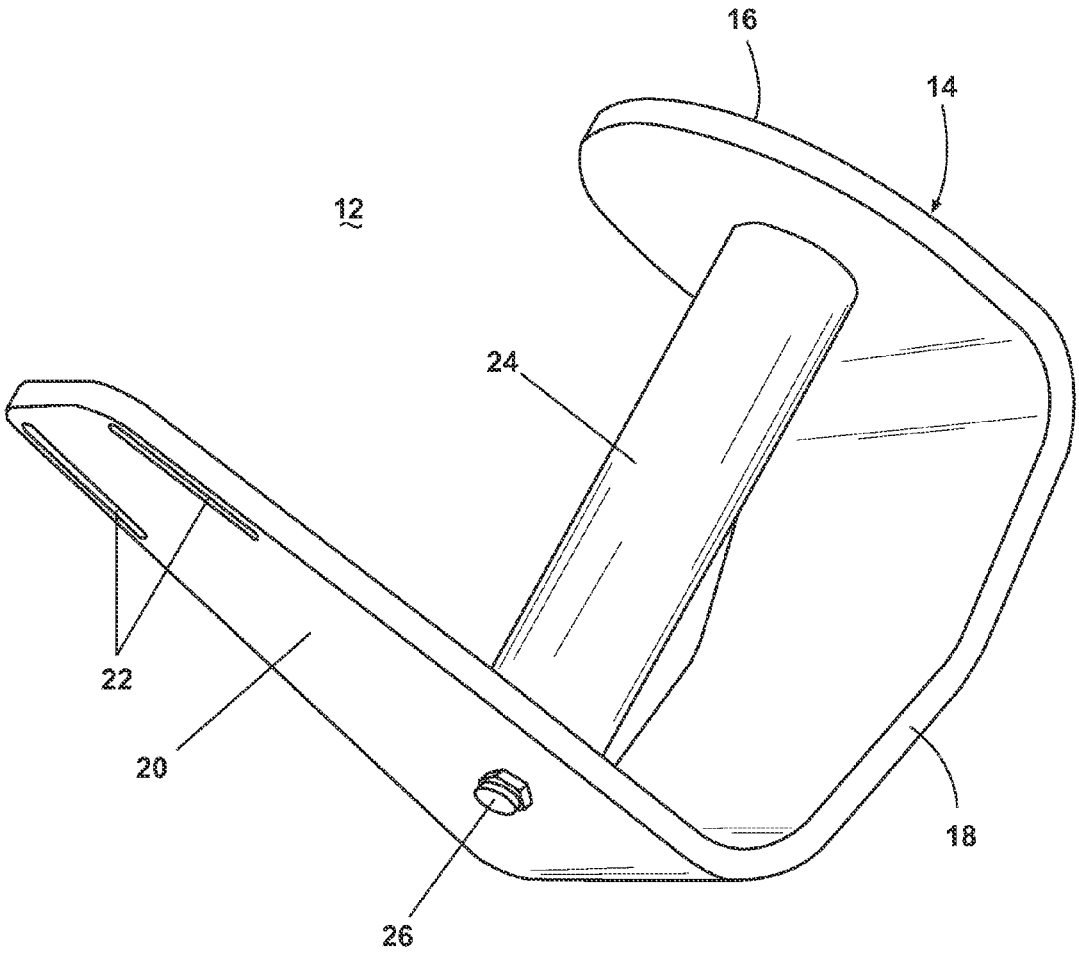
FIG. 1 is a side perspective view of an open U-shaped hand protector with a stabilizing arm according to one embodiment of the invention.
Figure 2:
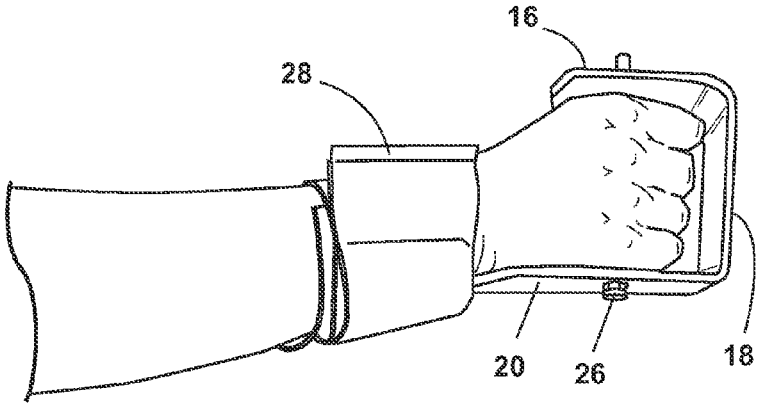
FIG. 2 is a side perspective view of the hand protector of FIG. 1, illustrating a hand grasping a handle and a strap binding an arm of the hand protector to a user's arm.
Figure 3:
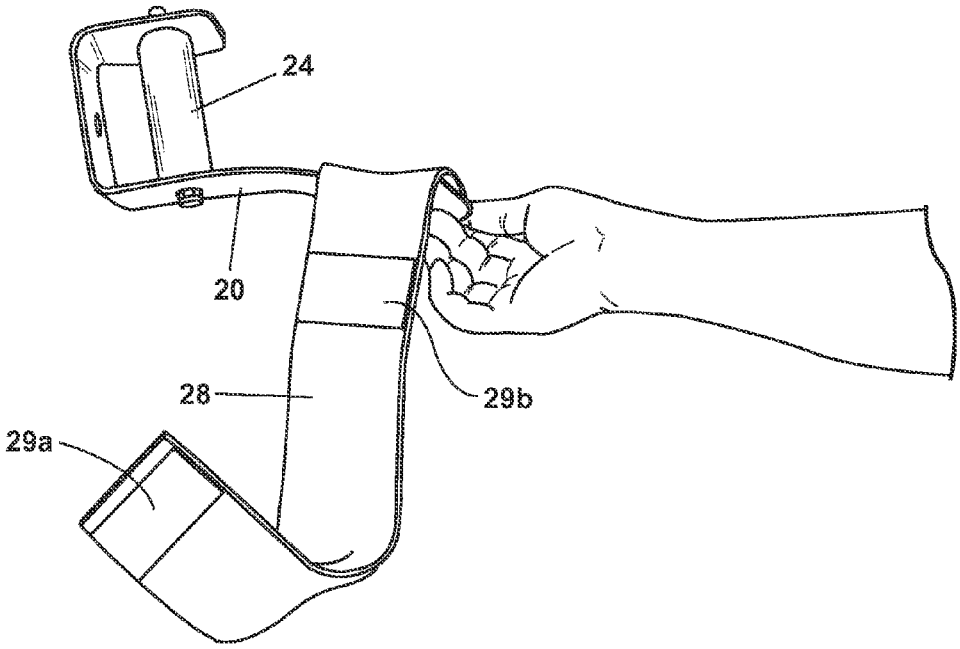
FIG. 3 is a side perspective view of the hand protector of FIG. 1, illustrating the strap attached to the hand protector.

The bight portion can be relatively flat as shown in FIGS. 2-5 or have a slight bend as illustrated in FIG. 1. In addition, the leg 20 can be straight as illustrated in FIG. 1 or can be preferably bent slightly as illustrated in FIGS. 2-5 to accommodate a natural bend between the hand and the arm.

The hand protector 12 can further include a padded disc 30 positioned on each side of the handle 24 adjacent to the legs 16 and 20 and configured to protect the user's hand during punching exercises.

Figure 8:
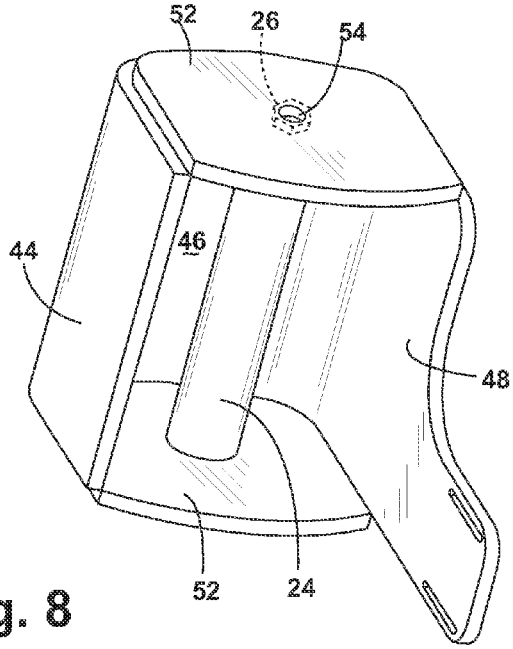
FIG. 8 is a bottom perspective view of the hand protector of FIG. 6.

Referring now to FIGS. 6-8, a hand protector 40 according to another embodiment of the invention is illustrated. The hand protector 40 has a U-shaped shield 42 that comprises a short leg 44, a bight portion 46 and a long leg 48. Slots 50 are provided at the upper portion of the long leg 48. The slots are designed to retain a strap (not shown) in the same manner as the hand protector 12 illustrated in FIGS. 2 and 3. The hand protector 40 additionally comprises two side plates 52 that extend perpendicularly between the legs 44, 48 and are spaced from one another. The handle 24 is mounted between the side plates 52, by a bolt 26 which extends through holes 54 in the side plates 52, as illustrated in FIGS. 7 and 8.

Figure 9:
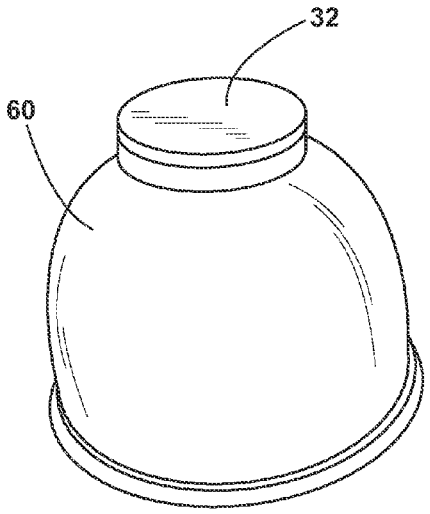
FIG. 9 is a top, side perspective view of a cup-shaped hand protector according to yet another embodiment of the invention.
Figure 10:
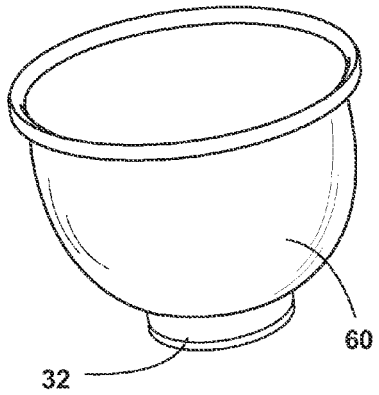
FIG. 10 is a bottom, side perspective view of the cup-shaped hand protector of FIG. 9.

Referring now to FIGS. 9 and 10, there are shown prospective views of a cup-shaped shield 60 having a rotatable padded disc 32, according to another embodiment of the invention.

Figure 11:
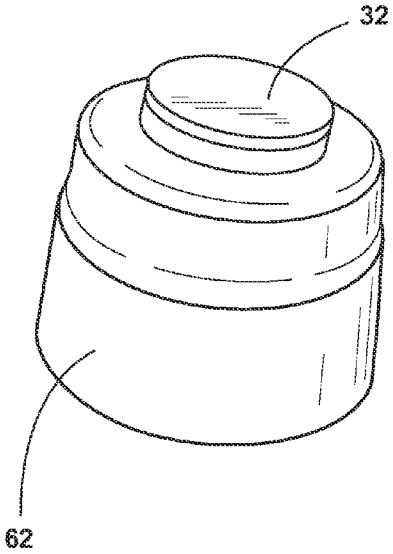
FIG. 11 is a top, side perspective view of a second cup-shaped hand protector according to another embodiment of the invention.
Figure 12:
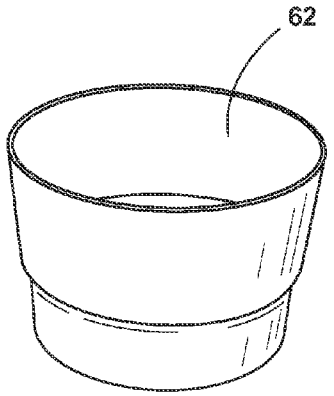
FIG. 12 is a bottom, side perspective view of the cup-shaped hand protector of FIG. 11.

Referring now to FIGS. 11 and 12, another form of a cup shaped shield 62 having a removable padded disc 32 at the end portions thereof is illustrated. Although not shown in FIGS. 19-12, a handle is mounted in the cup shaped shield to support the hand of a user, in a manner similar to the previous embodiments.

It is contemplated that this hand protector, according to any of the described embodiments of FIGS. 4-12, can also be used for traditional push-up exercises. During a push-up, the user's arm can undergo some rotational movement, which can be accommodated by the rotatable padded disc 32. This rotational motion is the same as when a boxer jabs the punching bag.

The rotatable padded disc 32 can be removed by pushing out the pin 36 from in inside of the bight portion 18 or can remain on the hand protector during punching.

According to any of the above described embodiments, the hand protector 12, 40, 60 transfers the force of impact in a punching operation to the palm of the user's hand and counters the force through the middle of the wrist on up to the center of the forearm as the user hits or punches a punching bag.

The invention as described above creates a new category of training and conditioning of athletes in the martial arts and the boxing world and for anyone, male, female, young or old. The invention provides a safe and easy way for anyone to punch a punching bag and gain higher levels of punching, boxing skills, and gain higher levels of physical conditioning by delivering blow after blow to the bag without hurting their hands, fist, or wrists. Hurting hands, fist, or wrists etc. is the problem solved with the invention.

Never has there been a tool to practice repetitive punching exercises with little concern of injury to the hand or wrist. Now, the boxer can throw a punch without the fear of pulling the delivered blow and can develop the perfect punch. The hand protector is easy too. Just grab it and start punching. No gloves. No taping of the fist. Lastly, the hand protector is a great tool for a non-boxer to punch a bag to release pent-up stress and frustrations.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A hand protector for use in punching bag exercises, comprising:

a shield made of a structural material and having a bight portion with an exterior surface that is adapted to resist deformation when struck against an article such as a punching bag and upright portions extending from the bight portion;

a hand grip rigidly mounted at the ends thereof between the shield upright portions;

wherein the hand grip is mounted in spaced relationship to the shield so that a user gripping the hand grip with a hand has hand portions spaced from the shield for protection during a punching exercise; and a pad rotatably mounted to the exterior surface of the bight portion of the shield in alignment with the hand grip.

2. A hand protector according to claim 1 wherein the shield is U-shaped in configuration and the upright portions comprise legs of the U-shape.

3. A hand protector according to claim 2 wherein one of the legs is longer than the other leg, and the longer leg has a strap for securing the arm of the user when the user's hand grips the hand grip.

4. A hand protector according to claim 3, wherein the longer of the legs is configured to support the wrist of the user when the strap is secured to the user's arm.

5. A hand protector according to claim 1 and further comprising pads mounted to the hand grip between a central portion thereof and the upright portions of the shield and configured to protect the user's hand during punching exercises.

6. A hand protector according to claim 1 wherein the pad is removably mounted to the shield.

7. A hand protector according to claim 6 wherein the pad comprises a disc having a pin perpendicular to the disc, wherein the pin is mounted in a hole in the bight portion.

8. A hand protector according to claim 7 wherein the disc and pin are integrally formed from a moldable resin material.

9. A hand protector according to claim 7 wherein the pad further comprises a layer of compressible material mounted to an outer surface of the disc.

10. A hand protector according to claim 1 wherein the shield is formed in a U-shape and the upright portions comprise side plates positioned between legs of the U-shape, wherein the hand grip is mounted between the side plates.

11. A hand protector according to claim 1 wherein the shield is cup-shaped in configuration.

12. A hand protector according to claim 1 wherein the hand grip is hollow, and a bolt extends through the hand grip and is attached at either end to the shield.

13. A hand protector according to claim 12 wherein the hand grip is padded.

14. A hand protector for use in punching bag exercises, comprising:

a shield made of a structural material and having a relatively flat bight portion with an exterior surface that is adapted to resist deformation when struck against an article such as a punching bag and legs extending from the bight portion, wherein one of the legs is longer than another leg, and the longer leg has a strap for securing the arm of the user when the user's hand grips the hand grip;

a hand grip rigidly mounted at the ends thereof between the shield legs; and wherein the hand grip is mounted in spaced relationship to the shield so that a user gripping the hand grip with a hand has hand portions spaced from the shield for protection during a punching exercise.

15. A hand protector according to claim 14 wherein the longer of the legs is configured to support the wrist of the user when the strap is secured to the user's arm.

16. A hand protector according to claim 14 wherein the strap has hook and loop fasteners to removably secure the strap to the arm of a user.

17. A method of exercising comprising punching a bag with one's hands wherein at least one of the user's hands grips the hand grip of the hand protector according to claim 1 during the punching step.

18. A method of exercising comprising punching a bag with one's hands wherein at least one of the hands grips the hand grip of the hand protector according to claim 14 and wherein a portion of the user's arm is bound by the strap.

19. A method of exercising comprising positioning one's body on a support surface in a push-up position and executing at least one push-up wherein the hands of the body grip the hand protector according to claim 2; and further comprising rotating one's hands about a vertical axis during the push-up executing act.

* * * * *